US008532511B2

(12) United States Patent
Komiya

(10) Patent No.: US 8,532,511 B2
(45) **Date of Patent: *Sep. 10, 2013**

(54) IMAGE FORMING APPARATUS AND IMAGE FORMING APPARATUS CONTROL METHOD

(75) Inventor: Yoshiyuki Komiya, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/528,938

(22) Filed: Jun. 21, 2012

(65) Prior Publication Data

US 2012/0263484 A1 Oct. 18, 2012

Related U.S. Application Data

(63) Continuation of application No. 11/949,134, filed on Dec. 3, 2007, now Pat. No. 8,229,307.

(30) Foreign Application Priority Data

Dec. 1, 2006 (JP) ..... 2006-326025

(51) Int. Cl.
*G03G 15/00* (2006.01)
*G03G 15/08* (2006.01)

(52) U.S. Cl.
USPC ..... 399/49; 399/53

(58) Field of Classification Search
USPC ..... 399/38, 49, 50, 53
See application file for complete search history.

(56) References Cited

U.S. PATENT DOCUMENTS 5,579,090 A 11/1996 Sasanuma et al.
5,887,223 A 3/1999 Sakai et al.
6,148,158 A 11/2000 Amemiya
6,418,281 B1 7/2002 Ohki
8,229,307 B2 * 7/2012 Komiya ..... 399/49

FOREIGN PATENT DOCUMENTS

JP 6-175501 A 6/1994
JP 8-275001 A 10/1996
JP 10063048 A 3/1998
JP 2000-238341 A 9/2000
JP 2004-64358 A 2/2004
JP 2004-306590 A 11/2004
JP 2005-025040 A 1/2005
JP 2005-103850 A 4/2005
JP 2006-201556 A 8/2006
JP 2006-235490 A 9/2006
JP 2006-264003 A 10/2006

OTHER PUBLICATIONS

JP Office Action issued Oct. 21, 2011 for JP2006-326025 (cited in parent US2008/0130052).

* cited by examiner

*Primary Examiner* — Sandra Brase
(74) *Attorney, Agent, or Firm* — Rossi, Kimms & McDowell LLP

(57) ABSTRACT

In an image forming apparatus, an image forming contrast potential for obtaining the maximum density is set by reading a specific pattern transferred and formed on a sheet. A photosensor detects the density of a specific pattern formed on an image carrier at the image forming contrast potential, and the detection result is stored. A correction amount for the image forming contrast potential is calculated on the basis of the relationship between the stored detected density, and the density, detected by the optical sensor, of the specific pattern formed on the image carrier at a predetermined timing. The image forming contrast potential is adjusted by the correction amount.

12 Claims, 18 Drawing Sheets

FIG. 13

| | ΔVcont | ΔDY | ΔDM | ΔDC | ΔDK |
|---|---|---|---|---|---|
| 1 | +50 | +0.13 | +0.14 | +0.15 | +0.12 |
| 2 | +25 | +0.05 | +0.06 | +0.07 | +0.04 |
| 3 | −25 | −0.06 | −0.06 | −0.06 | −0.05 |
| 4 | −50 | −0.11 | −0.12 | −0.12 | −0.11 |

IMAGE FORMING APPARATUS AND IMAGE FORMING APPARATUS CONTROL METHOD

This is a continuation of U.S. patent application Ser. No. 11/949,134 filed Dec. 3, 2007, the entire contents of which are herein incorporated by reference.

BACKGROUND OF THE INVENTION

1. Field of the Invention

The present invention relates to an image forming apparatus such as a copying machine or laser beam printer which forms an image by transferring a toner image of at least one color onto a sheet by an electrophotographic method or electrostatic recording scheme, and an image forming apparatus control method.

2. Description of the Related Art

FIG. 18 shows an example of a conventional image forming apparatus.

The image forming apparatus comprises a rotary developing unit 3 rotatably supported by a rotation support (not shown). The rotary developing unit 3 includes a yellow toner developing unit 3Y, magenta toner developing unit 3M, cyan toner developing unit 3C, and black toner developing unit 3K.

The color toner developing units 3Y, 3M, 3C, and 3K of the rotary developing unit 3 sequentially face a photosensitive drum 4 to develop images with the respective color toners.

The photosensitive drum 4 serving as a photosensitive body is driven to rotate at a predetermined angular velocity, and the drum surface is uniformly charged by a charger 8. The drum surface is exposed and scanned with a laser beam in accordance with image data of the first color (e.g., yellow), forming an electrostatic latent image of the first color on the photosensitive drum 4. The yellow toner developing unit 3Y for the first color develops and visualizes the electrostatic latent image. The visualized first toner image is transferred onto an intermediate transfer member 5 driven to rotate in press contact with the photosensitive drum 4 at a predetermined press force.

This transfer process is similarly repeated for the remaining toners (magenta, cyan, and black). Toner images of the respective colors are sequentially transferred onto the intermediate transfer member 5, forming a color image. For a full-color print, color images transferred on the intermediate transfer member 5 are transferred at once onto a sheet 6 fed from a sheet feed unit. The sheet 6 bearing the color images is discharged after the fixing process by a fixing unit 7, obtaining a full-color print.

These days, as the number of full-color outputs increases, the stability of density of an output image and the stability of tonality are required of electrophotographic image forming apparatuses of this type.

In this situation, there is proposed an image density/tonality control method of stably maintaining density for a long period in electrophotographic image forming apparatuses such as a copying machine and printer.

According to this proposal, an image forming condition table corresponding to the environmental status and the durable number of sheets is stored in advance. The environment around the image forming apparatus is detected from an output from an environmental sensor incorporated in the image forming apparatus.

The durable number of sheets of the image forming apparatus or process unit is detected from a sheet counter incorporated in the main body. Appropriate image forming conditions are selected from the image forming condition table on the basis of the durable number of sheets.

According to this proposal, however, it is difficult to cope with a case where the state of the image forming apparatus deviates from the image forming condition table due to an unexpected use. A small change of the state of the image forming apparatus cannot be tracked.

To solve this, there is proposed the following technique. First, a density sensor detects the density of a specific toner patch formed on a photosensitive drum or transfer member. Then, image forming conditions are selected on the basis of the detected density. The image forming apparatus is controlled to obtain a predetermined density or tonality.

According to this proposal, the image forming apparatus can be controlled in accordance with its state, and a stable image can be obtained for a long period. A fine output image according to the state of the image forming apparatus can be attained by executing density/tonality control when the image forming apparatus starts up after left to stand for a long time, or every predetermined number of sheets.

Recently, the throughput needs to be maintained while stabilizing the density and tonality, in order to obtain a fine output image according to the state of the image forming apparatus. With this proposal, however, it is difficult to satisfy both the control frequency and maintenance of the throughput.

Density/tonality control is done by detecting not the density on a sheet but a pattern formed on the photosensitive drum or transfer member. Thus, a density obtained by control and an actual density on the sheet differ from each other.

To solve these problems, the following technique is proposed for tonality control in an image forming apparatus.

According to this proposal, an image reader reads a specific tone pattern formed on a sheet, determining a density correction characteristic. An optical sensor detects the density of an image formed on an image carrier such as the photosensitive drum in accordance with the density correction characteristic, storing the detection result.

The density correction characteristic is adjusted on the basis of the relationship between the stored detected density and the density, detected by the optical sensor, of an image formed on the image carrier at a predetermined timing (see, e.g., Japanese Patent No. 3441994).

In Japanese Patent No. 3441994, the density at each halftone level can be adjusted to a desired one by correcting the density correction characteristic on the basis of the relationship between the stored detected density and the detected density of an image formed on the image carrier at a predetermined timing. However, the maximum density cannot be adjusted to a desired one.

As for the maximum density, an image forming contrast potential is set as an image forming condition defined when the density correction characteristic is determined.

For example, even if the maximum density decreases upon the lapse of time after determining the density correction characteristic, it cannot be increased by the method of correcting the density correction characteristic (input signal) because there is no means for increasing the maximum density upon density variations.

When the optical sensor detects the density of a specific pattern formed on the image carrier such as the photosensitive drum, especially an optical sensor using specularly reflected light is lower in detection precision in the high-density region than in the low- and intermediate-density regions, and the detection value greatly varies.

For this reason, no high detection precision can be obtained when controlling the maximum density by forming a high-density pattern in solid black or the like on the image carrier and detecting it.

It is an object of the present invention to provide an image forming apparatus capable of maintaining the throughput, and maintaining a desired maximum density stably at high precision for a long period, and an image forming apparatus control method.

SUMMARY OF THE INVENTION

According to one aspect of the present invention, there is provided an image forming apparatus having an optical sensor which detects a density on an image carrier, the apparatus comprises:

an image forming contrast potential setting unit adapted to set an image forming contrast potential for obtaining a maximum density by reading a specific pattern transferred and formed on a sheet;

a storage unit adapted to store a density, detected by the optical sensor, of a specific pattern formed on the image carrier at the image forming contrast potential;

a correction amount calculation unit adapted to calculate a correction amount for the image forming contrast potential set by the image forming contrast potential setting unit on the basis of a relationship between the detected density stored in the storage unit, and the density, detected by the optical sensor, of the specific pattern formed on the image carrier at a predetermined timing; and an adjustment unit adapted to adjust the image forming contrast potential by the correction amount calculated by the correction amount calculation unit.

According to another aspect of the present invention, there is provided a method of controlling an image forming apparatus having an optical sensor which detects a density on an image carrier, the method comprises the steps of:

setting an image forming contrast potential for obtaining a maximum density by reading a specific pattern transferred and formed on a sheet;

storing a density, detected by the optical sensor, of a specific pattern formed on the image carrier at the image forming contrast potential;

calculating a correction amount for the image forming contrast potential set in the image forming contrast potential setting step on the basis of a relationship between the detected density stored in the storing step, and the density, detected by the optical sensor, of the specific pattern formed on the image carrier at a predetermined timing; and adjusting the image forming contrast potential by the correction amount calculated in the correction amount calculating step.

The present invention can maintain the throughput, and maintain a desired maximum density stably at high precision for a long period.

Further features of the present invention will become apparent from the following description of exemplary embodiments (with reference to the attached drawings).

BRIEF DESCRIPTION OF THE DRAWINGS

FIG. 13 is a table showing the relationship between the difference contrast potential and the difference density;

DESCRIPTION OF THE EMBODIMENTS

Figure 1:
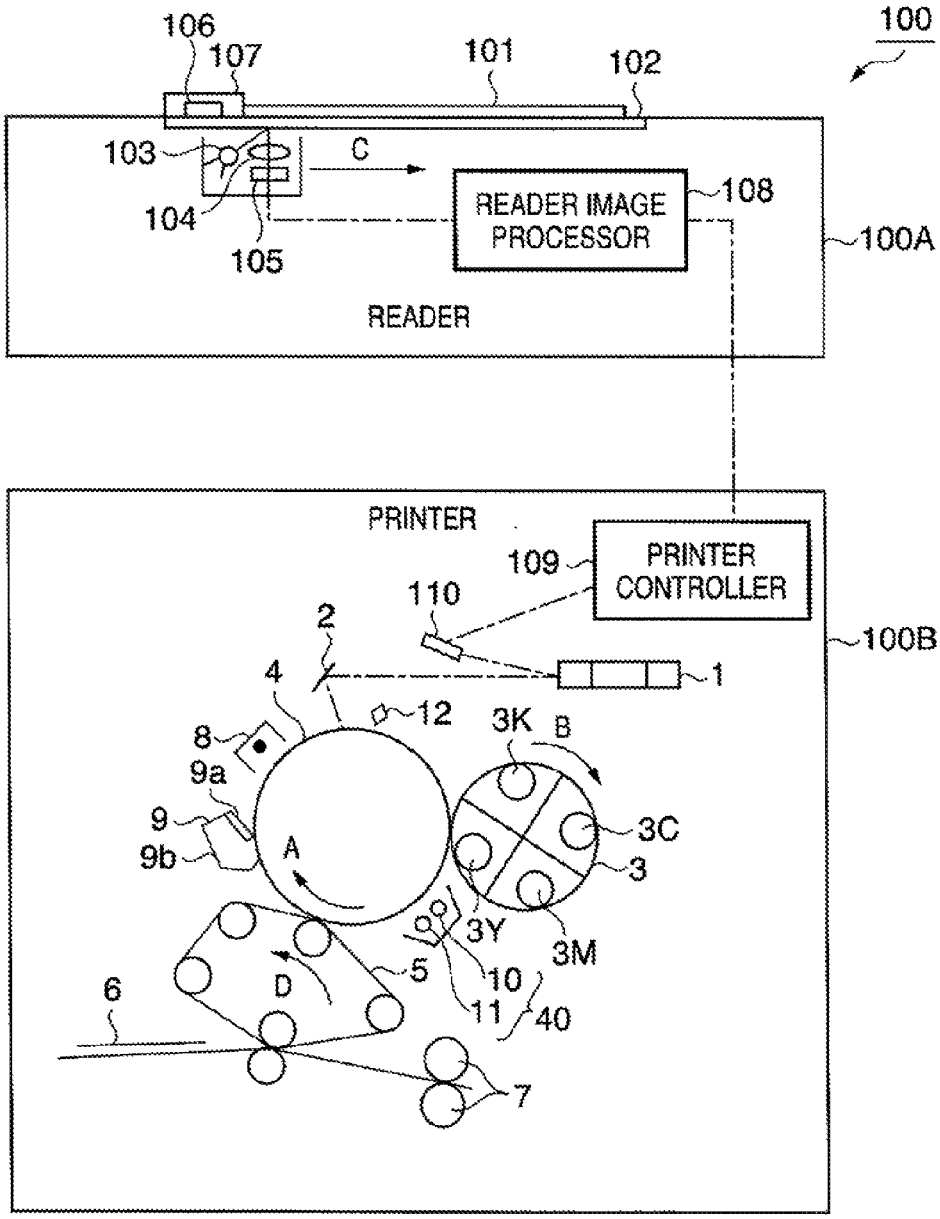
FIG. 1 is a schematic sectional view for explaining an image forming apparatus as an example of the embodiment of the present invention.
Figure 2:
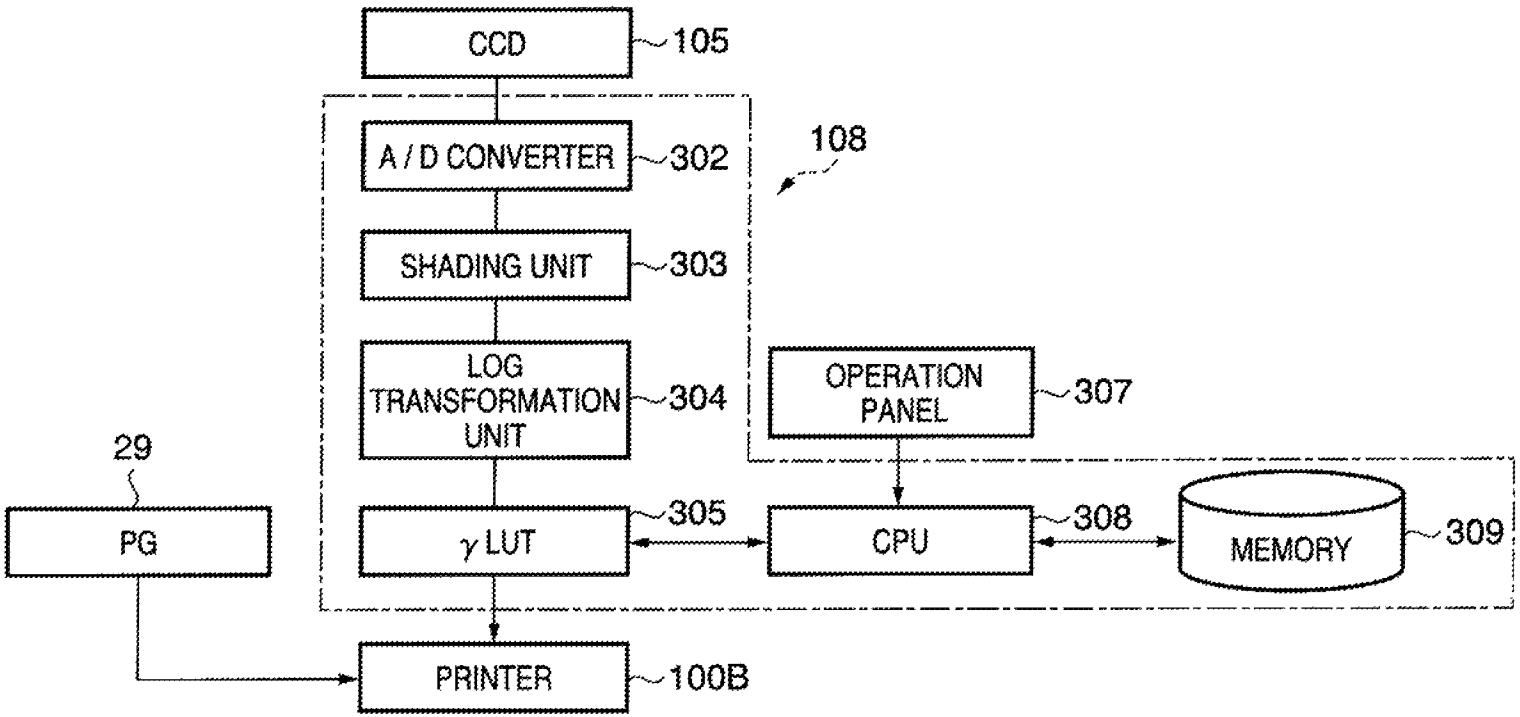
FIG. 2 is a control block diagram for explaining the image processor of a reader.
Figure 3:
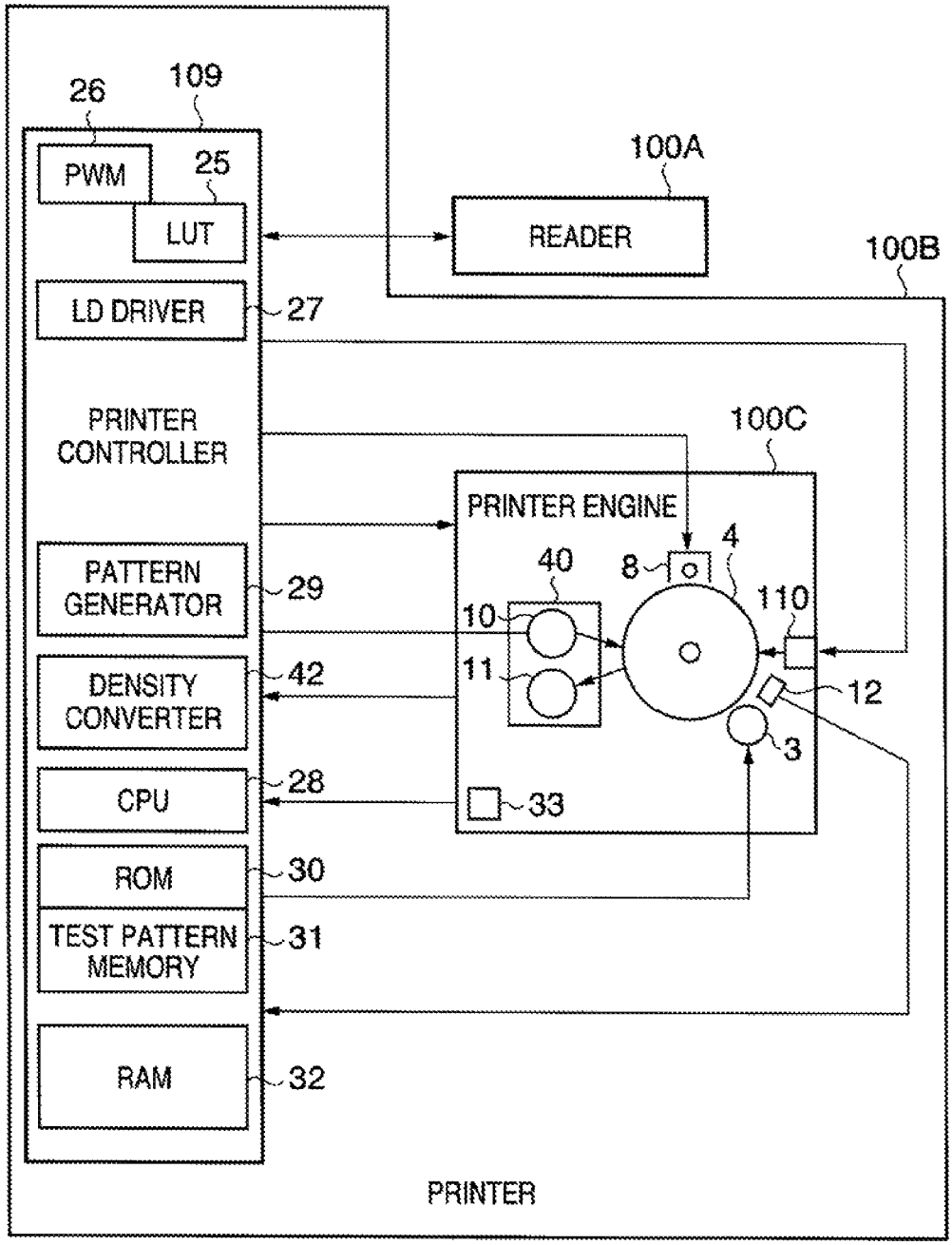
FIG. 3 is a control block diagram of a printer.

An embodiment of the present invention will be described below with reference to the accompanying drawings. FIG. 1 is a schematic sectional view for explaining an image forming apparatus as an example of the embodiment of the present invention. FIG. 2 is a control block diagram for explaining the image processor of a reader. FIG. 3 is a control block diagram of the image forming apparatus as an example of the embodiment of the present invention.

As shown in FIG. 1, an image forming apparatus 100 as an example of the embodiment of the present invention comprises a reader (image reading device) 100A and printer 100B.

The reader 100A will be described first.

The reader 100A comprises an original plate 102. An original 101 set on the original plate 102 is irradiated by a light source 103, and light reflected by the original 101 is formed into an image on a CCD sensor 105 via an optical system 104.

In the CCD sensor 105, three arrays of red, green, and blue CCD line sensors generate red, green, and blue component signals, respectively. The reading optical system unit including the light source 103, optical system 104, and CCD sensor 105 is scanned in a direction indicated by an arrow C in FIG. 1 to convert the original 101 into an electrical signal data string for each line.

An abutment member 107 is arranged on the original plate 102. The end of the original 101 abuts against the abutment member 107 to prevent the original 101 from being set obliquely. Further, a reference white plate 106 is arranged on the original plate 102 to perform shading of the CCD sensor 105 in the thrust direction in order to determine the white level of the CCD sensor 105.

An image signal obtained by the CCD sensor 105 undergoes image processing by a reader image processor 108, is sent to the printer 100B, and undergoes predetermined image processing by a printer controller 109.

As shown in FIG. 2, the reader image processor 108 comprises an A/D converter 302 which converts the brightness signal of an original image sensed by the CCD sensor 105 into a digital signal. A shading unit 303 receives the digital brightness signal, and executes shading correction for nonuniformity of the light quantity caused by sensitivity variations between elements of the CCD sensor 105. The shading correction improves the measurement reproducibility of the CCD sensor 105.

A LOG transformation unit 304 LOG-transforms the brightness signal corrected by the shading unit 303. A γ-LUT (Look Up Table) creation unit 305 receives the LOG-transformed signal, and creates a table which makes a density characteristic ideal for the printer 100B coincide with an output image density characteristic processed in accordance with the γ characteristic.

Referring back to FIG. 1, the printer 100B will be described.

In FIG. 1, the printer 100B comprises a corona charger 8 serving as a charging means for applying a bias to a photosensitive drum 4 and charging the drum surface uniformly to a negative polarity. The photosensitive drum 4 whose surface is uniformly charged is irradiated with a laser beam which is emitted from a laser source 110 and reflected by a polygon mirror 1 and mirror 2. The laser beam is converted into image data by a laser driver 27 (see FIG. 3) incorporated in the printer controller 109. The photosensitive drum 4 bearing a latent image formed by laser beam scanning rotates in a direction indicated by an arrow A shown in FIG. 1.

The printer 100B comprises a rotary developing unit 3 supported by a rotation support (not shown) so as to be rotatable in the direction indicated by the arrow A in FIG. 1. The rotary developing unit 3 includes a yellow toner developing unit 3Y, magenta toner developing unit 3M, cyan toner developing unit 3C, and black toner developing unit 3K. In the embodiment, the developer is a two-component developer containing magnetic and nonmagnetic carriers. The color toner developing units 3Y, 3M, 3C, and 3K of the rotary developing unit 3 sequentially face the photosensitive drum 4 to develop images with the respective color toners.

The photosensitive drum 4 is driven to rotate at a predetermined angular velocity, and the drum surface is uniformly charged (to −500 V in the embodiment) by the charger 8. The drum surface is exposed and scanned by a laser beam in accordance with image data of the first color (e.g., yellow), forming an electrostatic latent image of the first color (about −150 V in the embodiment) on the photosensitive drum 4. The yellow toner developing unit 3Y for the first color develops and visualizes the electrostatic latent image.

The visualized first toner image is transferred onto an intermediate transfer member 5 driven to rotate in a direction indicated by an arrow D in FIG. 1 at almost the same speed (273 mm/s in the embodiment) as the peripheral speed of the photosensitive drum 4 while being in press contact with the photosensitive drum 4 at a predetermined press force.

This primary transfer process is similarly repeated for the remaining toners (magenta, cyan, and black). Toner images of the respective colors are sequentially transferred onto the intermediate transfer member 5, forming a color image. For a full-color print, color images transferred on the intermediate transfer member 5 are transferred at once onto a sheet 6 fed from a sheet feed unit. The sheet 6 bearing the color images is discharged after the fixing process by a fixing unit 7, obtaining a full-color print.

Toner left on the photosensitive drum 4 without being transferred onto the intermediate transfer member 5 in the primary transfer process is scraped by a cleaning blade 9*a* of a cleaning means 9 in press contact with the photosensitive drum 4, and recovered into a disposal toner vessel 9*b*.

The printer 100B also comprises a photosensor (optical sensor) 40 which detects the reflected light quantity of a toner patch pattern formed on the photosensitive drum 4, and an environmental sensor 13 which measures the moisture content in air inside the apparatus. The photosensor 40 includes an LED light source 10 (having a dominant wavelength of about 960 nm) and a photodiode 11.

The control system of the printer 100B will be explained with reference to FIG. 3.

The printer controller 109 comprises a CPU 28, a ROM 30, a RAM 32, a test pattern memory 31, a density converter 42, a γ-LUT converter 25, a pattern generator 29, the laser driver 27, and a PWM 26.

By looking up the table of the γ-LUT creation unit 305 of the reader 100A, the γ-LUT converter 25 converts an image signal so as to make a density characteristic ideal for the printer 100B coincide with an output image density characteristic processed in accordance with the γ characteristic.

The printer controller 109 can communicate with a printer engine 100C, and controls the photosensor 40, the primary charger 8, the laser source 110, a surface potential sensor 12, and the rotary developing unit 3 which are arranged around the photosensitive drum 4 of the printer engine 100C.

The surface potential sensor 12 is arranged upstream of the developing unit 3 in the rotational direction of the photosensitive drum. The CPU 28 of the printer controller 109 controls the grid potential of the primary charger 8 and the developing bias of the rotary developing unit 3.

An image forming apparatus control method as an example of the embodiment of the present invention will be explained separately in the first to third control processes.

The first control process will be described with reference to FIGS. 2 and 4.

Figure 4:
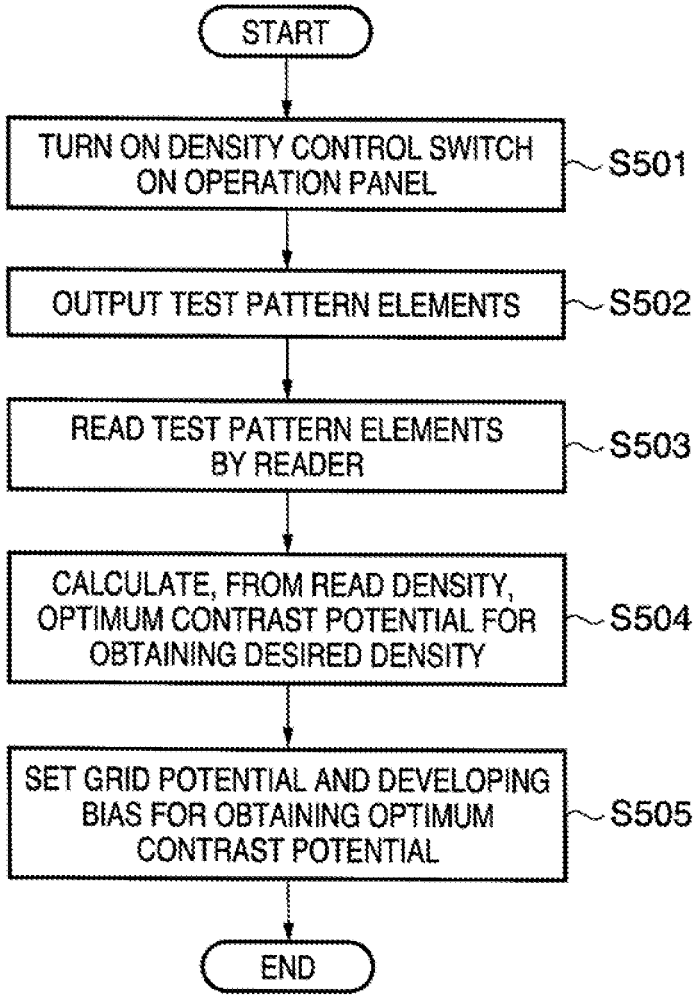
FIG. 4 is a flowchart for explaining the operation of the first control process.

When the user turns on a density control start switch on an operation panel 307 (see FIG. 2) in step S501 of FIG. 4, the process shifts to step S502. In step S502, the pattern generator (PG) 29 of the printer controller 109 outputs test patterns in four, yellow, magenta, cyan, and black colors onto the photosensitive drum 4, transferring and forming them on a sheet.

Figure 5:
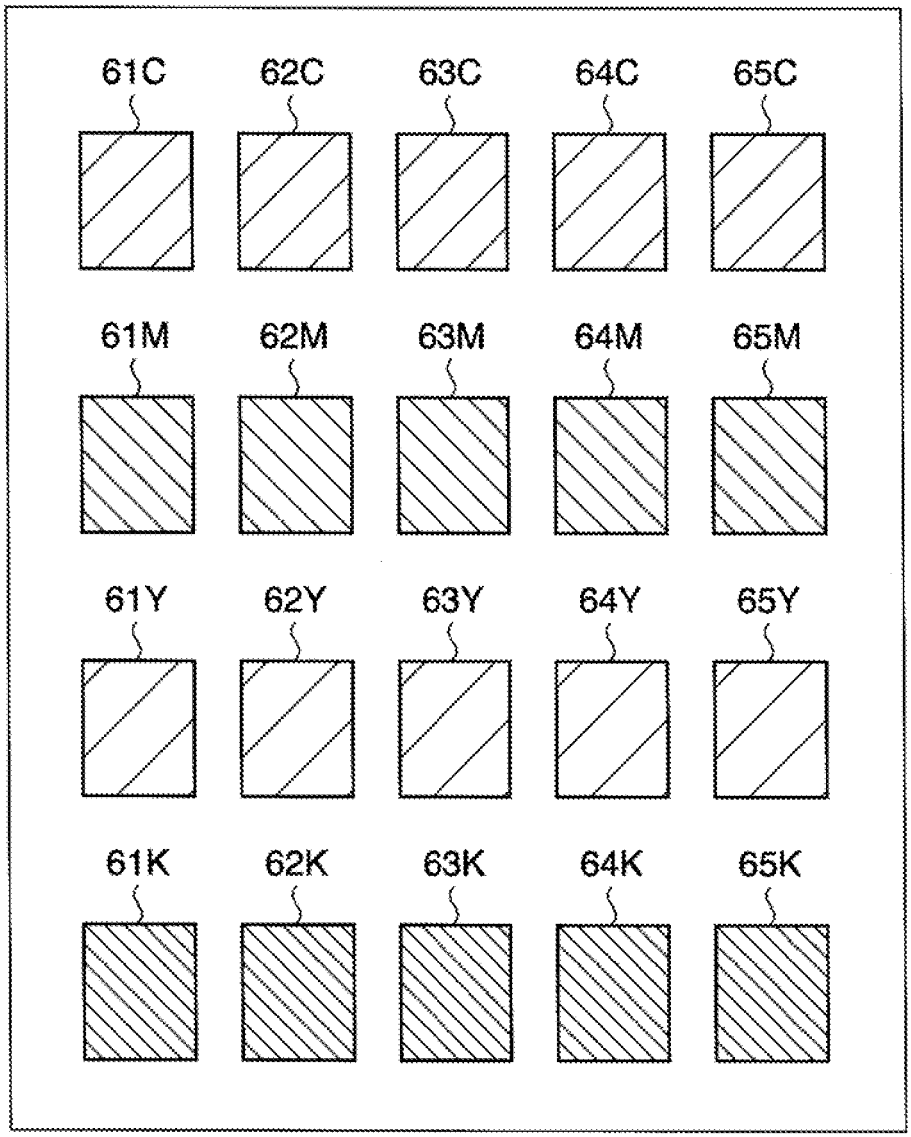
FIG. 5 is a view showing an example of test pattern elements transferred and formed on a sheet.

FIG. 5 shows an example of the test pattern. In FIG. 5, patterns 61 to 65 are maximum-density patterns in Y, M, C, and K, respectively. The patterns 61 to 65 include pattern elements 61Y to 65Y, 61M to 65M, 61C to 65C, and 61K to 65K, respectively, that is, each include five elements.

A method of forming the maximum-density pattern of each step will be explained.

Figure 6:
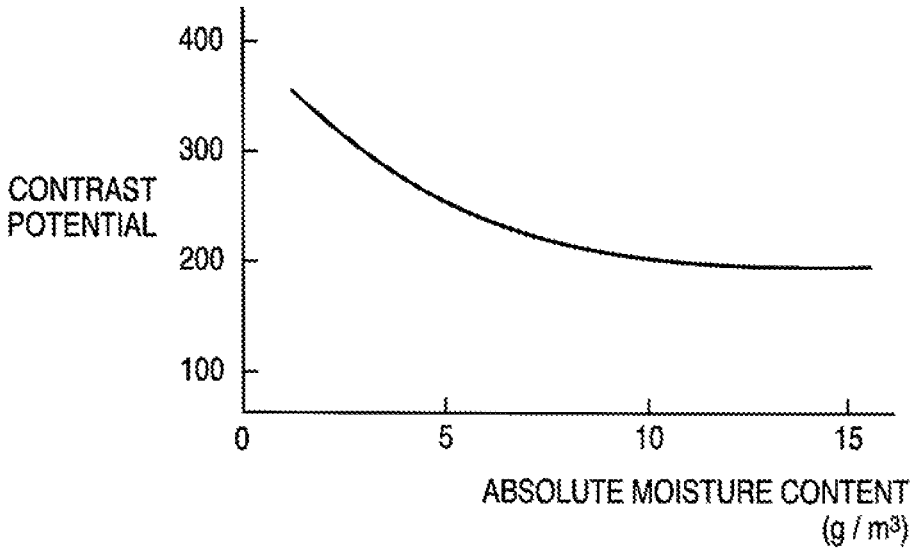
FIG. 6 is a graph showing the relationship between the absolute moisture content and the contrast potential.

Reference contrast potentials Vcont0Y to Vcont0K set for the respective colors are obtained in advance based on the moisture content in air inside the apparatus that is obtained from an output from an environmental sensor 33. Assume that a contrast potential corresponding to the absolute moisture content is set in advance, as shown in FIG. 6.

Figure 7:
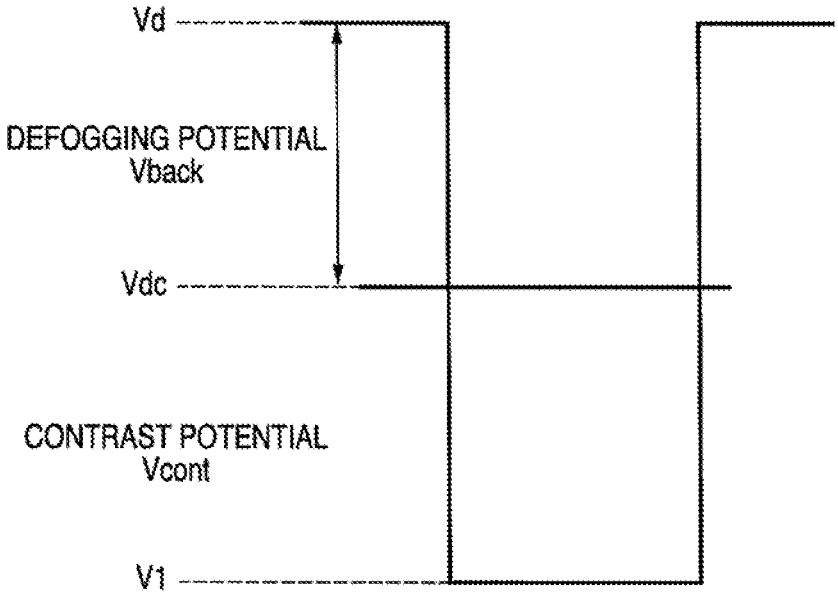
FIG. 7 is a chart for explaining the image forming contrast potential.

As shown in FIG. 7, the contrast potential Vcont is the difference voltage between a developing bias Vdc and a surface potential V1 of the exposed photosensitive drum 4. As Vcont becomes higher, the maximum density becomes higher.

The respective toner patch pattern elements are formed at predetermined potential widths (every 25 V in the embodiment) from the set reference contrast potentials Vcont0Y to Vcont0K serving as medians.

The pattern elements 61Y to 65Y in FIG. 5 will be exemplified. In the embodiment, five pattern elements corresponding to set contrast potentials of Vcont0Y+50 V for 61Y, Vcont0Y+25 V for 62Y, Vcont0Y for 63Y, Vcont0Y−25 V for 64Y, and Vcont0Y−50 V for 65Y are formed in levels with a maximum signal value of 255.

Similarly the pattern elements 61M to 65M, 61C to 65C, and 61K to 65K are formed using the reference contrast potentials Vcont0M, Vcont0C, and Vcont0K as medians for the respective colors.

In step S503 of FIG. 4, the sheet bearing the maximum-density test pattern elements is set on the original plate 102 of the reader 100A to read the test pattern elements.

Figure 8:
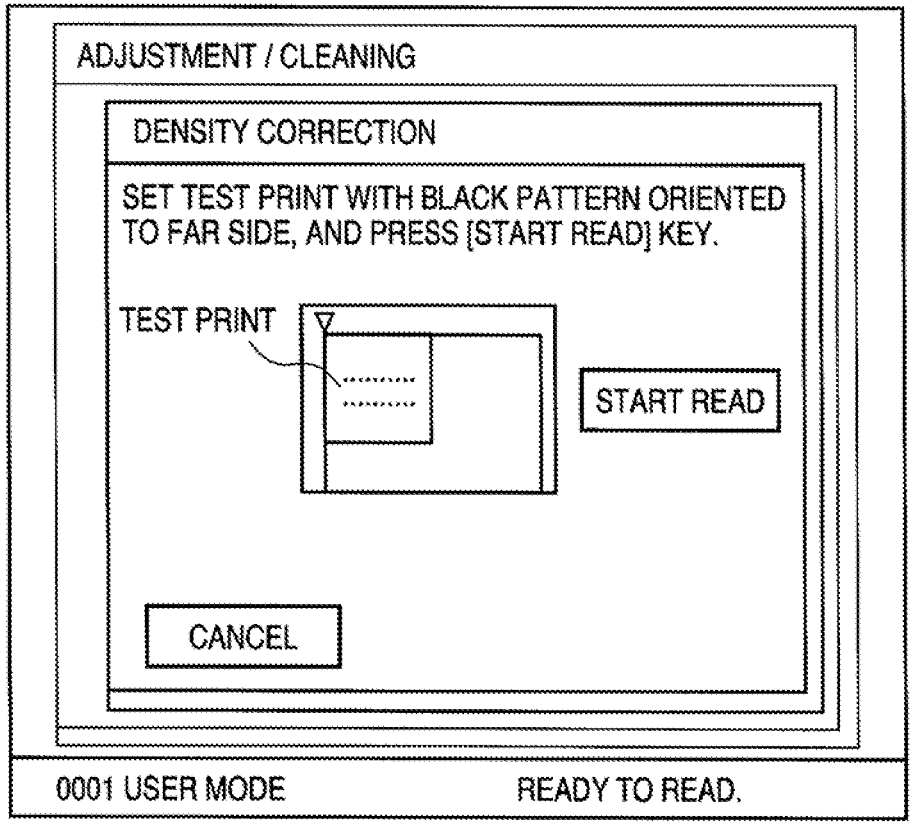
FIG. 8 is a view showing a display example of an operation panel.

FIG. 8 shows an example of a window displayed on the operation panel 307 when reading the test pattern elements. When the user presses a reading start button in FIG. 8, the maximum-density test pattern elements on the sheet are read by the reader 100A, and converted into light quantity signals by the CCD sensor 105. A CPU 308 receives the light quantity signals as read density data via the A/D converter 302, shading unit 303, and LOG transformation unit 304.

In step S504 of FIG. 4, an optimum contrast potential is calculated from read density data of each color so as to obtain a desired maximum density.

Figure 9A:
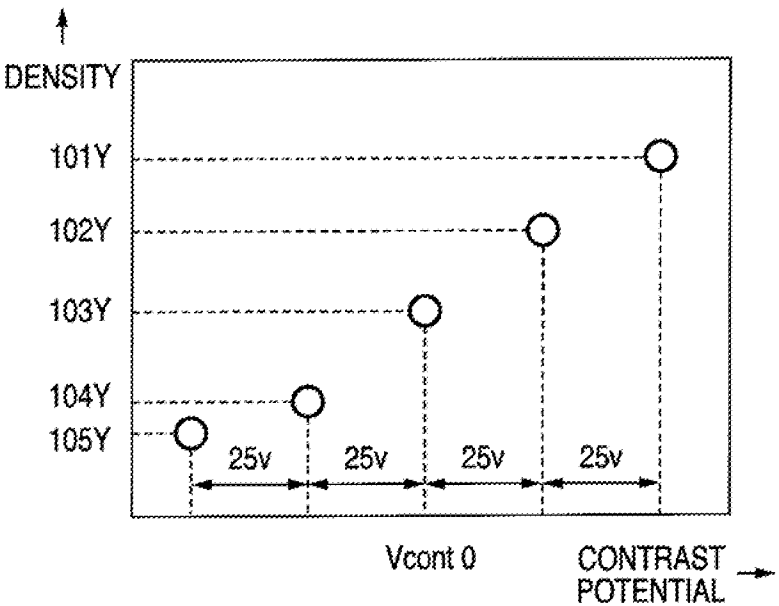
FIGS. 9A and 9B are graphs for explaining a method of calculating the image forming contrast potential.
Figure 9B:
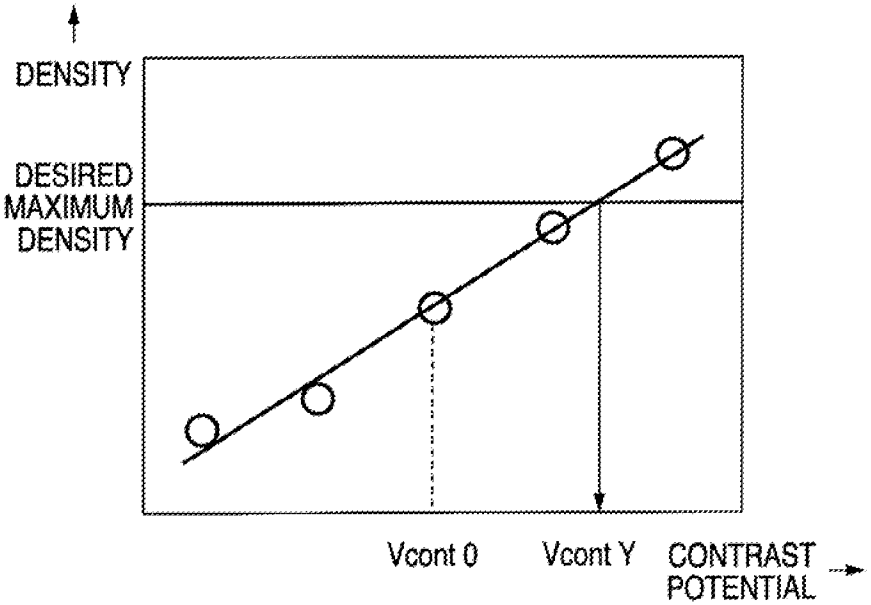

An example of a method of calculating an optimum contrast potential will be described with reference to FIGS. 9A and 9B.

Density data 101Y to 105Y are obtained by reading the maximum-density pattern elements 61Y to 65Y among the test pattern elements shown in FIG. 5. The contrast potential VcontY at which a desired density can be obtained is calculated from a straight line obtained by linearly approximating the density data 101Y to 105Y.

Similarly, the optimum contrast potentials VcontM, VcontC, and VcontK for the respective colors are calculated from density data 101M to 105M, 101C to 105C, and 101K to 105K obtained by reading the pattern elements 61M to 65M, 61C to 65C, and 61K to 65K.

In the embodiment, the optimum contrast potential is calculated by linearly approximating data at five points. Instead, the optimum contrast potential may also be calculated by approximation based on a multidimensional function, or linear interpolation of two points between which a desired density exists.

In step S505 of FIG. 4, the CPU (image forming contrast potential setting means) 28 sets a grid potential and developing bias potential (or exposure) so as to attain optimum contrast potentials which are calculated in step S504 so as to obtain desired maximum densities.

The second control process executed after the first control process will be explained.

Figure 10:
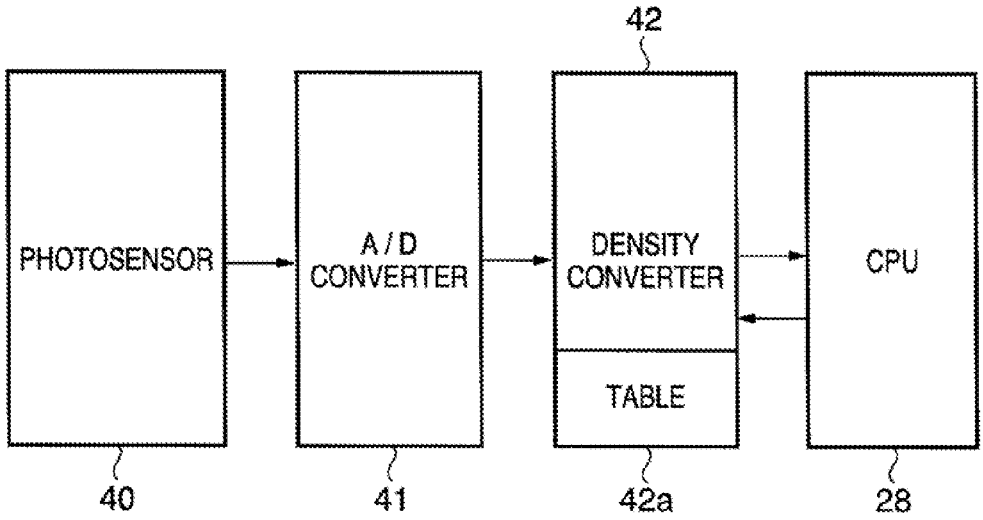
FIG. 10 is a block diagram of a circuit which processes a signal from a photosensor.

The photosensor 40 will be described with reference to FIG. 10. The photosensor 40 converts, into an electrical signal, near-infrared light traveling from the photosensitive drum 4 to the photosensor 40. An A/D converter 41 converts the electrical signal having an output voltage of 0 to 5 V into a digital signal of 0 to 255 levels. The density converter 42 converts the digital signal into a density. The photosensor 40 is configured to detect only specularly reflected light from the photosensitive drum 4.

Figure 12:
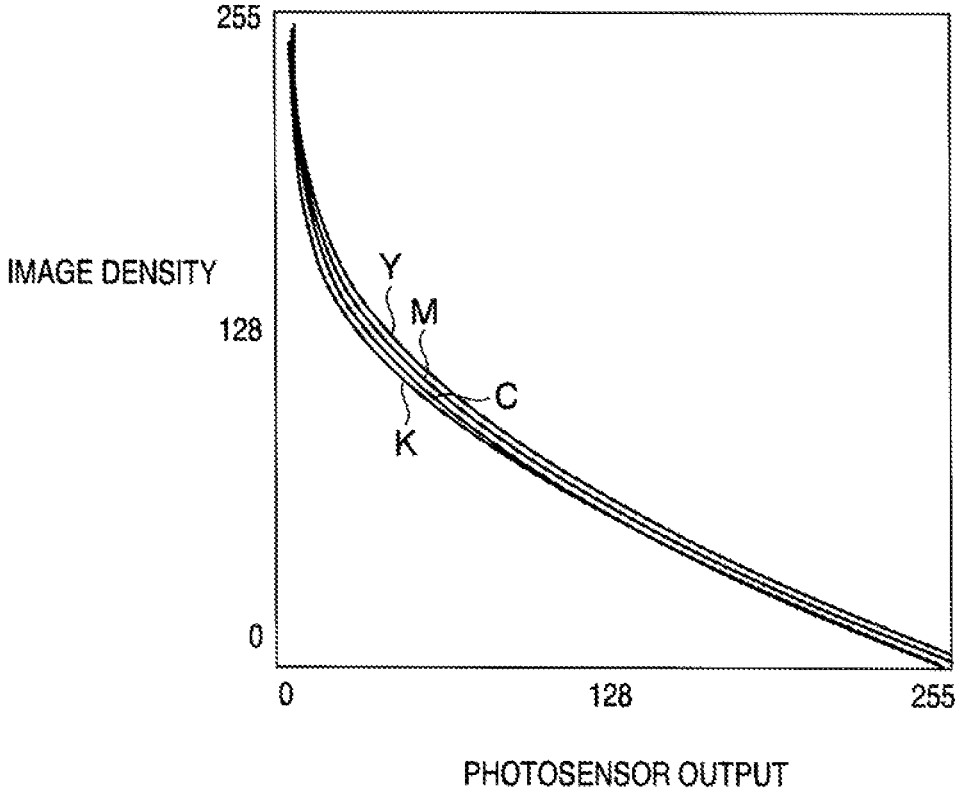
FIG. 12 is a graph showing the relationship between the photosensor output and the image density.

FIG. 12 shows the relationship between an output from the photosensor 40 and the output image density when the density on the photosensitive drum 4 is changed stepwise by area coverage modulation of each color. In FIG. 12, an output from the photosensor 40 is set to 5 V, i.e., level "255" when no toner attaches to the photosensitive drum 4.

As is apparent from FIG. 12, as the area coverage by each toner increases and the image density increases, an output from the photosensor 40 becomes smaller than that obtained when no toner attaches to the photosensitive drum 4. From these characteristics, the density signal of each color can be read at high precision by preparing a table 42*a* for converting a sensor output signal of each color into a density signal.

Figure 14:
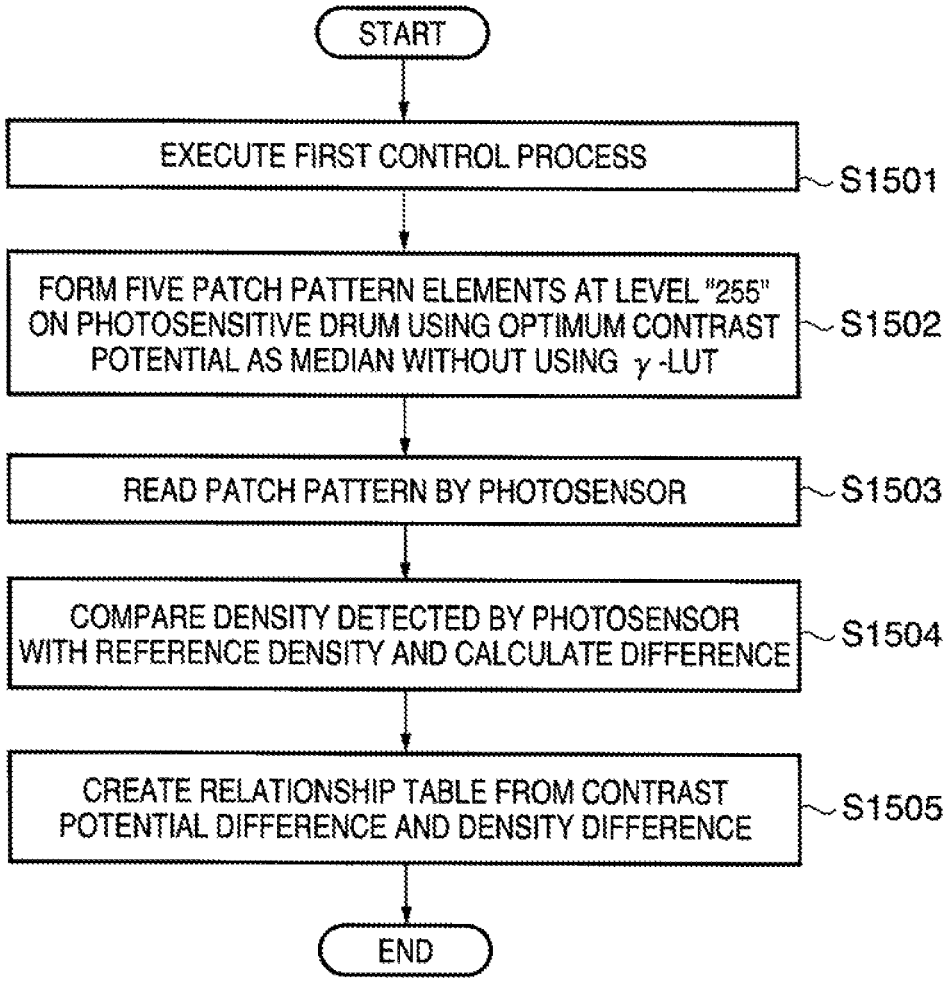
FIG. 14 is a flowchart for explaining the second control process.

The second control process will be described with reference to FIG. 14.

In step S1501, the first control process is executed. After optimum contrast potentials are set for the respective colors so as to attain desired maximum densities, the printer 100B forms, in step S1502, the respective toner patch pattern elements in Y, M, C, and K at predetermined potential widths (every 25 V in the embodiment) whose medians are set to the contrast potentials calculated in the first control process.

In step S1503, the photosensor 40 detects the developed patch patterns of the respective colors.

In the embodiment, the signal level of the patch pattern formed in the second control process is set to levels "255" to "144", and a signal is output based on the original γ characteristic of the image forming apparatus without performing conversion by the γ-LUT converter 25. The reason why conversion by the γ-LUT converter 25 is not executed is that this control aims to control the absolute density with respect to the contrast density of the image forming apparatus.

As described above, the photosensor 40 detects an image density on the basis of the area coverage of toner. As the density comes near the high-density region, i.e., the area coverage increases, the output is saturated, the sensor detection precision decreases, and the detection value tends to vary. Originally, it is preferable to directly detect the density of target solid black or a density in the high-density region close to solid black in order to detect a desired maximum density. Hence, the density of solid black at which the sensor detection precision is low, or a density in the high-density region close to solid black has conventionally been detected.

To the contrary, according to the embodiment, while a pattern at conventional signal levels "255" to "144", i.e., a pattern in solid black or in the high-density region close to solid black is formed, variations in detection value by a decrease in sensor detection precision can be reduced in steps S1504 and S51505. The embodiment uses signal level "255".

In step S1504, a difference ΔVcont of the contrast potential of each patch pattern from the optimum contrast potential VcontY set in the first control process is calculated. Also, differences ΔDY, ΔDM, ΔDC, and ΔDK of patch pattern densities from density obtained by detecting, by the photosensor 40, a patch pattern formed on the photosensitive drum 4 at the optimum contrast potential VcontY are calculated. In step S1505, a table shown in FIG. 13 is created from the differences and stored.

Figure 11:
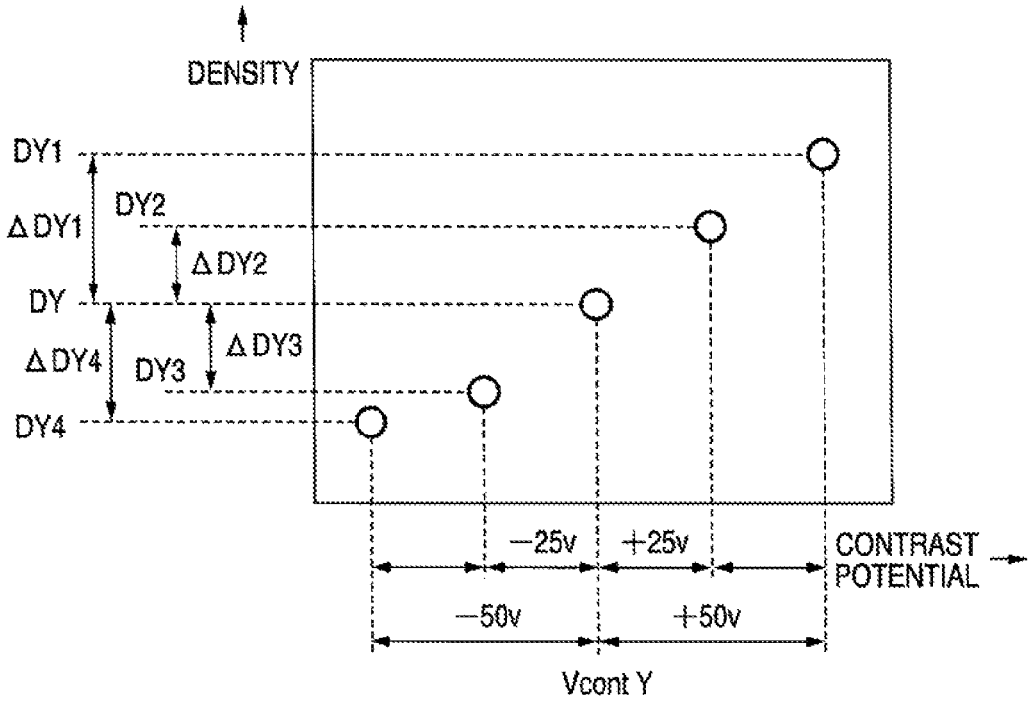
FIG. 11 is a graph showing the relationship between the difference contrast potential and the difference density.

More specifically, a reference density DY is defined as the density of a patch pattern formed on the photosensitive drum 4 at the optimum contrast potential VcontY set in the first control process, as shown in FIG. 11. The table shown in FIG. 13 stores, as ΔDY1, ΔDY2, ΔDY3, and ΔDY4, the differences between the reference density DY and densities DY1, DY2, DY3, and DY4 detected by the photosensor 40 when patch patterns are formed at contrast potentials VcontY+50 V, VcontY+25 V, VcontY−25 V, and VcontY−50 V.

Similarly for M, C, and K, ΔDM1 to ΔDM4, ΔDC1 to ΔDC4, and ΔDK1 to ΔDK4 are calculated to create the table shown in FIG. 13. The table is stored in, e.g., the ROM (storage means) 30.

In this manner, calibration of the photosensor 40 is performed by storing, as differences from the reference density, patch pattern (level "255") densities detected by the photosensor 40 in the second control process executed immediately after the first control process.

Thus, variations in detection value can be suppressed to perform control at high precision even by using a pattern in solid black suffering variations in detection value due to a decrease in sensor detection precision or a pattern in the high-density region close to solid black.

The third control process will be explained with reference to FIG. 15.

As described above, by executing the second control process, the table representing the relationship between the contrast potential and the density on the basis of the reference density of each color is created and stored. In the third control process executed at a predetermined timing after the second control process, the contrast potential set in the first control process is corrected on the basis of the difference between the reference density and a patch pattern density detected by the photosensor 40.

The third control process is executed when the main switch of the image forming apparatus is turned on, after a predetermined time elapses upon turning on the main switch, after a predetermined number of images are formed, or when an output from the environmental sensor 33 changes at a predetermined level or higher.

Figure 15:
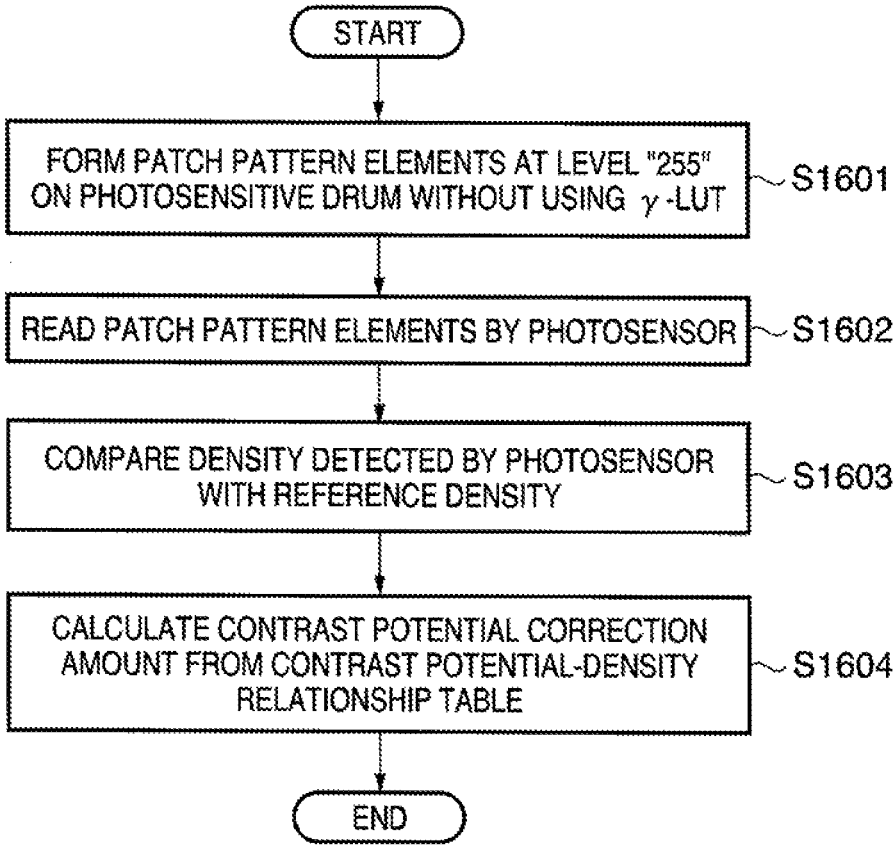
FIG. 15 is a flowchart for explaining the third control process.

In step S1601 of FIG. 15, when the start timing of the third control process comes upon turning on the main switch, patch pattern elements at level "255" is formed on the photosensitive drum 4 at the optimum contrast potential VcontY set in the first control process. At this time, the patch pattern elements are formed on the photosensitive drum 4 in accordance with the original γ characteristic without performing conversion by the γ-LUT converter 25.

In step S1602, the photosensor 40 detects the patch pattern elements formed on the photosensitive drum 4. In step S1603, the detected density value is compared with the reference density obtained in the second control process. In step S1604, the CPU (correction amount calculation means) 28 calculates a correction contrast potential ΔVcontY by looking up, on the basis of the difference in step S1603, the contrast potential-density relationship table shown in FIG. 13 obtained in the second control process.

Figure 16A:
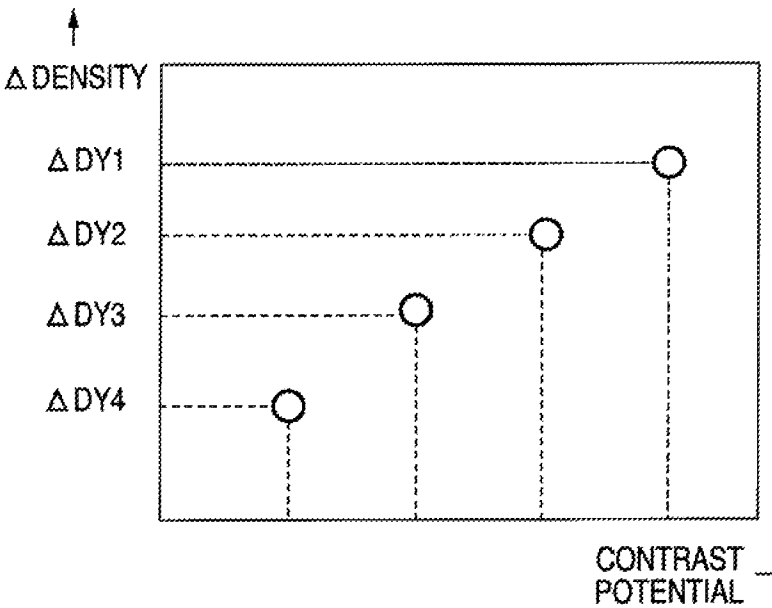
FIGS. 16A and 16B are graphs for explaining a method of calculating the correction contrast potential.
Figure 16B:
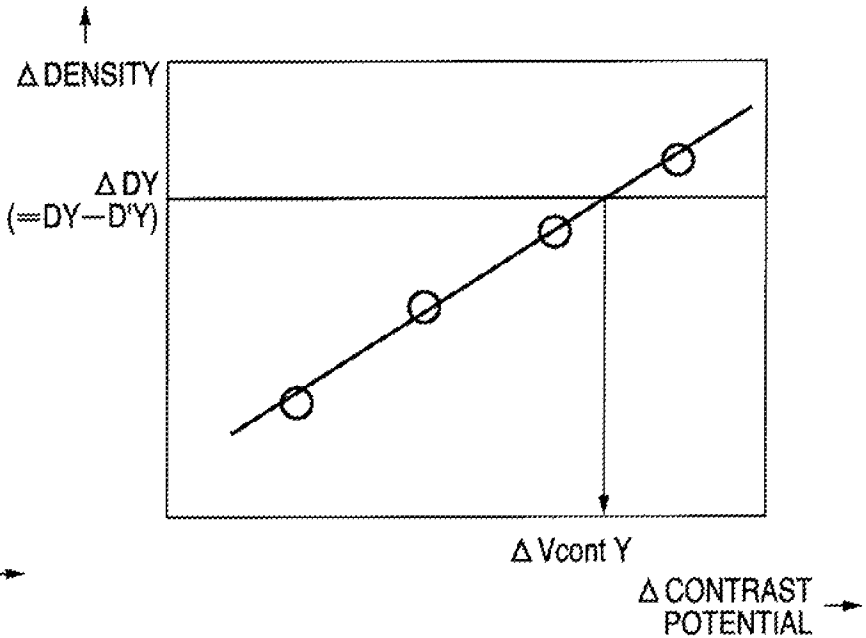

An example of calculating the correction contrast potential ΔVcontY will be explained with reference to FIGS. 16A and 16B.

The density of a patch pattern at level "255" that is detected by the photosensor 40 in the third control process is defined as D'Y. A difference ΔDY between the patch pattern density D'Y and the reference density DY obtained in the second control process is calculated. Then, the correction contrast potential ΔVcontY corresponding to the difference ΔDY is determined from the contrast potential-density relationship table (FIG. 13) obtained in the second control process.

In the embodiment, the correction contrast potential ΔVcontY is calculated by linear approximation based on the contrast potential-density relationship table (FIG. 13). The correction contrast potential ΔVcontY may also be calculated by approximation based on a multidimensional function, or linear interpolation of two points between which the difference ΔDY exists.

The CPU (adjustment means) 28 adds the correction contrast potential ΔVcontY obtained in the third control process to the contrast potential VcontY set in the first control process. As a result, a corrected contrast potential Vcont1Y is attained.

Similarly for M, C, and K, correction contrast potentials ΔVcontM to ΔVcontK are calculated, and corrected contrast potentials Vcont1M to Vcont1K are calculated.

In many cases, the image forming apparatus is turned off in the evening and on in the morning. The third control process is performed at least once a day. In contrast, the first and second control processes are accompanied by manual work, and thus are not expected to be executed so frequently.

From this, according to the embodiment, the serviceman executes the first and second control processes when the image forming apparatus is installed, cleaned, or maintained. After that, as long as the density is proper, the performance is automatically maintained in a short period by the third control process. As for characteristics which change gradually in a long period, they are calibrated by the first and second control processes. The image forming apparatus can, therefore, maintain appropriate density for a long period.

The third control process can be achieved using one patch pattern for each color at minimum by a simpler arrangement as compared with a conventional control system which corrects the maximum density. A stable density can be maintained without decreasing the throughput.

Since a desired density target is set by the first and second control processes, calibration of the photosensor 40 can be done. Even when a patch pattern in solid black or a pattern having a high density close to solid black is formed, variations in detection value by a decrease in the detection precision of the photosensor 40 can be suppressed.

In the embodiment, the signal level of the patch pattern formed in the second and third control processes is set at level "255". However, a pattern in the low- or intermediate-density region at level "144" or a lower level may also be formed because calibration of the photosensor 40 is executed in the first and second control processes.

In this case, the toner amount to form a patch can be reduced, suppressing the toner consumption amount in control. Since the load on the cleaning means 9 can be reduced, the service life of the cleaning means 9 can be prolonged.

Figure 17:
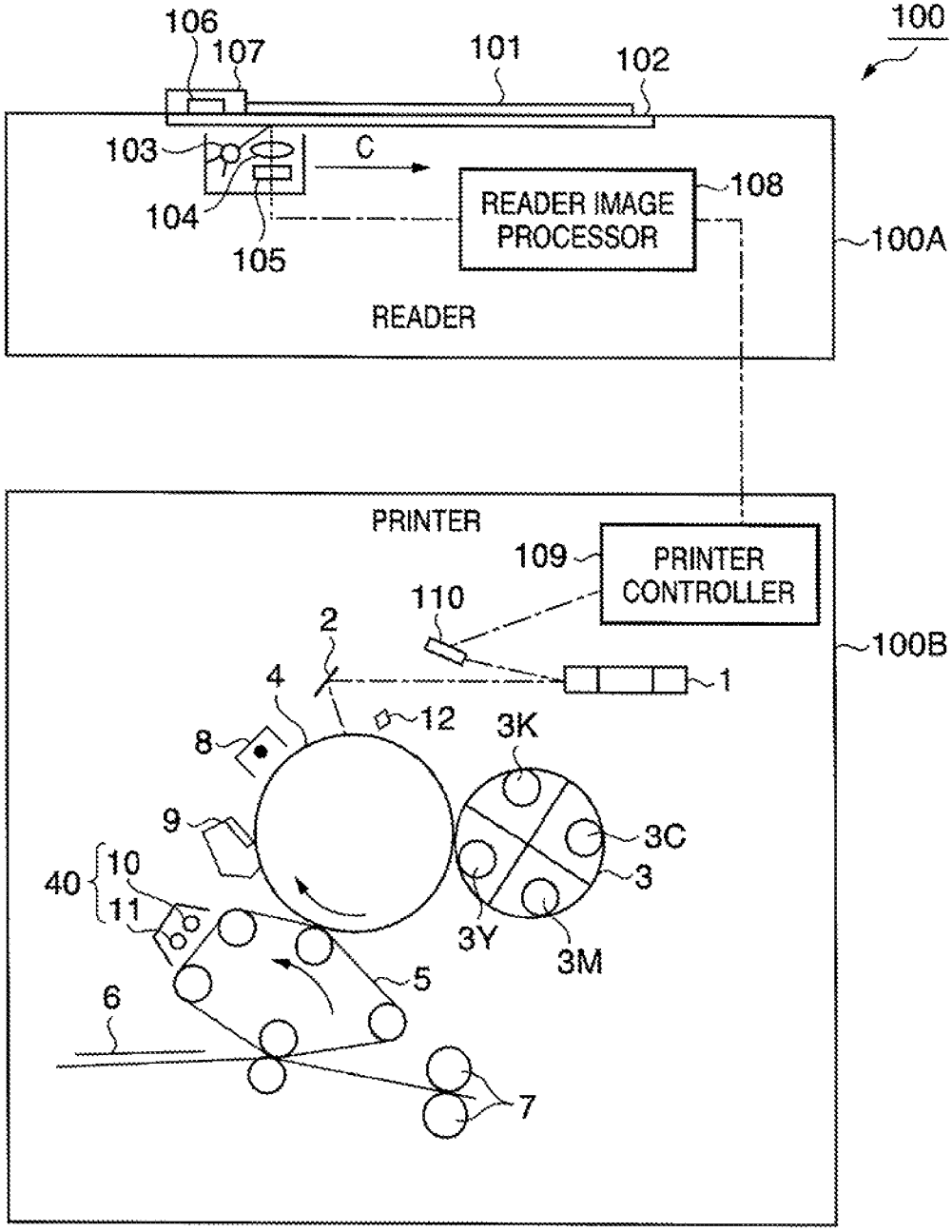
FIG. 17 is a schematic sectional view for explaining an image forming apparatus according to another embodiment of the present invention.
Figure 18:
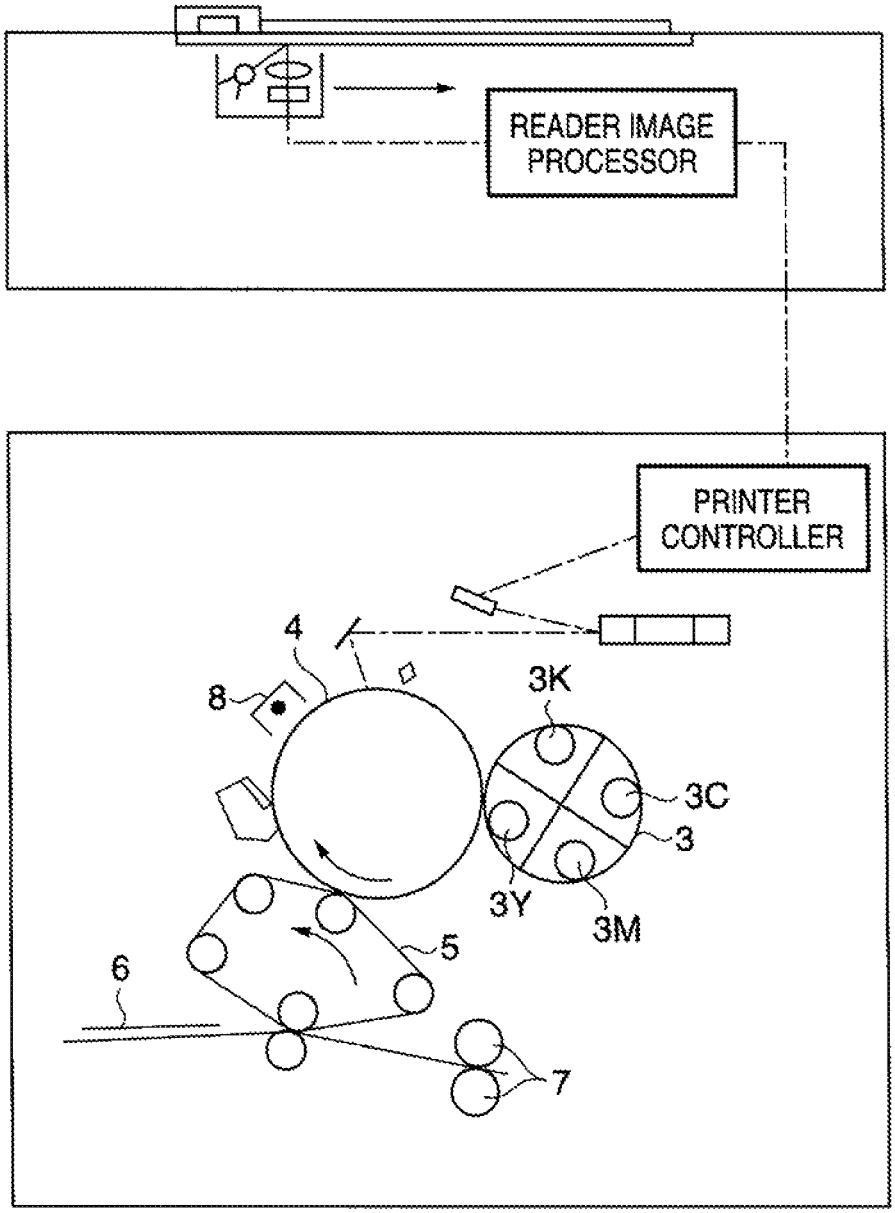
FIG. 18 PRIOR ART
FIG. 18 is a schematic sectional view showing an example of a conventional image forming apparatus.

An image forming apparatus according to another embodiment of the present invention will be described with reference to FIG. 17. In FIG. 17, the same reference numerals denote the same parts in the above-described embodiment, and a description thereof will be omitted.

In the above-described embodiment, the photosensor 40 detects a toner patch pattern formed on the photosensitive drum 4 in the second and third control processes. In the embodiment corresponding to FIG. 17, a photosensor 40 detects a patch pattern formed on an intermediate transfer member (image carrier) 5.

The intermediate transfer member 5 has a smaller number of degradation factors than those of a photosensitive drum 4, and can detect and determine the density characteristic including even the influence of transfer. Hence, a further increase in density correction precision can be expected. The remaining arrangement and operation effects are the same as those of the above-described embodiment.

In this embodiment, a patch pattern is detected on the intermediate transfer member 5. However, the present invention is applicable to any member such as a transfer belt for conveying a sheet as long as a patch pattern can be detected.

The embodiment employs the reflection photosensor 40, but the present invention may also adopt a transmission sensor as long as a transparent material is used for the intermediate transfer member, transfer belt, or the like.

Assume that a storage medium which stores software program codes for implementing the functions of the above-described embodiments is supplied to a system or apparatus. In this case, the object of the present invention is also achieved by reading out and executing the program codes stored in the storage medium by the computer (or the CPU or MPU) of the system or apparatus.

In this case, the program codes read out from the storage medium implement the functions of the above-described embodiments, and the program codes and the storage medium which stores the program codes constitute the present invention.

The storage medium for supplying the program codes includes a flexible disk, hard disk, and magnetooptical disk. Also, the storage medium includes an optical disk (e.g., CD-ROM, CD-R, CD-RW, DVD-ROM, DVD-RAM, DVD-RW, or DVD+RW), magnetic tape, nonvolatile memory card, and ROM. The program codes may also be downloaded via a network.

The functions of the above-described embodiments are implemented when the computer executes the readout program codes. Also, the present invention includes a case where an OS (Operating System) or the like running on the computer performs part or all of actual processing on the basis of the instructions of the program codes and thereby implements the functions of the above-described embodiments.

Assume that the program codes read out from the storage medium are written in the memory of a function expansion board inserted into the computer or the memory of a function expansion unit connected to the computer. In this case, the present invention includes a case where the functions of the above-described embodiments are implemented when the CPU of the function expansion board or function expansion unit performs part or all of actual processing on the basis of the instructions of the program codes and thereby implements the functions of the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-326025, filed Dec. 1, 2006, which is hereby incorporated by reference herein in its entirety.

What is claimed is:

1. An image forming apparatus comprising:

a reading device adapted to read a document;

an image forming unit adapted to form a toner image based on an image of the document read by the reading device, and control a contrast potential to be used for forming a toner image by the image forming unit according to input image data, the contrast potential being a difference voltage between (1) a surface potential of a photosensitive member charged by the image forming unit and exposed by a predetermined output of the image forming unit and (2) a developing bias to be applied for developing the photosensitive member with a toner by the image forming unit;

a control unit adapted to print out a test sheet, a first measurement toner image being formed on the test sheet by the image forming unit;

a first density detection unit adapted to, when the reading device reads the first measurement toner image on the test sheet, detect a first density of the first measurement toner image based on a reading result of the test sheet read by the reading device;

a contrast potential determining unit adapted to determine a first contrast potential so that the first density of the first measurement toner image becomes a predetermined density, based on a detecting result of the first density detection unit;

a second density detection unit adapted to detect a second density of a second measurement toner image formed by the image forming unit using a second contrast potential;

a characteristic determining unit adapted to determine a characteristic representing a relationship of (a) the second contrast potential and (b) the second density of the second measurement toner image detected by the second density detection unit; and a correction unit adapted to correct the first contrast potential determined by the contrast potential determining unit, based on (i) the second density of the second measurement toner image formed by the image forming unit using the first contrast potential, detected by the second density detection unit and (ii) the characteristic determined by the characteristic determining unit.

2. The apparatus according to claim 1, wherein the second density detection unit detects the second density of a toner image formed on the photosensitive member by the image forming unit.

3. The apparatus according to claim 2, wherein the toner image formed on the photosensitive member is transferred to an intermediate transfer member.

4. The apparatus according to claim 2, wherein the toner image formed on the photosensitive member is transferred to a sheet.

5. The apparatus according to claim 1, wherein the toner image read by the reading device for determining the first contrast potential, is formed using a contrast potential according to a moisture content in air inside the image forming apparatus.

6. The apparatus according to claim 1, wherein:

the second measurement toner image includes a plurality of second measurement toner images formed by the image forming unit using a plurality of different second contrast potentials, the characteristic determining unit determines the characteristic based on second densities of the plurality of second measurement toner images detected by the second density detection unit.

7. The apparatus according to claim 6, wherein the plurality of different second contrast potentials include the first contrast potential determined by the contrast potential determining unit.

8. The apparatus according to claim 6, wherein the characteristic represents a ratio between (a) a difference between the plurality of different second contrast potentials and (b) a difference between the second densities of the plurality of second measurement toner images.

9. A method of controlling an image forming apparatus that has a reading device adapted to read a document; an image forming unit adapted to form a toner image based on an image of the document read by the reading device, and control a contrast potential to be used for forming a toner image by the image forming unit according to input image data, the contrast potential being a difference voltage between (1) a surface potential of a photosensitive member charged by the image forming unit and exposed by a predetermined output of the image forming unit and (2) a developing bias to be applied for developing the photosensitive member with a toner by the image forming unit; and a density detection unit adapted to detect a density of the toner image formed by the image forming unit, the method comprising:

a test printing step of printing out a test sheet, a first measurement toner image being formed on the test sheet by the image forming unit;

a reading step of reading the first measurement toner image on the test sheet with the reading device;

a density detecting step of detecting a first density of the first measurement toner image formed on the test sheet, based on a reading result of the reading step;

a contrast potential determining step of determining a first contrast potential so that the first density of the first measurement toner image becomes a predetermined density, based on a detecting result of the density detecting step;

a first measurement image forming step of forming a second measurement toner image by the image forming unit using a second contrast potential;

a characteristic determining step of determining a characteristic representing a relationship of (a) the second contrast potential and (b) a second density of the second measurement toner image detected by the density detection unit; and a second measurement image forming step of forming a third measurement toner image by the image forming unit using the first contrast potential determined in the contrast potential determining step;

a correction step of correcting the first contrast potential determined in the contrast potential determining step, based on (i) a third density of the third measurement toner image detected by the density detection unit and (ii) the characteristic determined in the characteristic determining step.

10. The method according to claim 9, wherein:

the second measurement toner image includes a plurality of second measurement toner images formed by the image forming unit using a plurality of different second contrast potentials, the characteristic determining step determines the characteristic based on second densities of the plurality of second measurement toner images detected by the density detection unit.

11. The method according to claim 10, wherein the plurality of different second contrast potentials include the first contrast potential determined in the contrast potential determining step.

12. The method according to claim 10, wherein the characteristic represents a ratio between (a) a difference between the plurality of different second contrast potentials and (b) a difference between the second densities of the plurality of second measurement toner images.

* * * * *